US006565410B1

(12) United States Patent
Allen

(10) Patent No.: US 6,565,410 B1
(45) Date of Patent: May 20, 2003

(54) RADIO-CONTROLLED TOY TRAIN

(76) Inventor: Edward R. Allen, 920-23 Co-Op City Blvd., Bronx, NY (US) 10475

( * ) Notice: Subject to any disclaimer, the term of this patent is extended or adjusted under 35 U.S.C. 154(b) by 0 days.

(21) Appl. No.: 10/189,229

(22) Filed: Jul. 5, 2002

(51) Int. Cl.[7] ..... A63H 19/24
(52) U.S. Cl. ..... 446/454; 446/467
(58) Field of Search ..... 446/454, 456, 446/467, 427, 433; 104/295

(56) References Cited

U.S. PATENT DOCUMENTS

| | | | | |
|---|---|---|---|---|
| 4,177,426 A | * | 12/1979 | Gaishin et al. | 340/825.69 |
| 4,424,470 A | * | 1/1984 | Finch | 318/6 |
| 5,050,505 A | * | 9/1991 | Konno | 104/295 |
| 5,437,233 A | * | 8/1995 | Richter | 104/279 |
| 5,816,887 A | * | 10/1998 | Rudell et al. | 446/427 |

FOREIGN PATENT DOCUMENTS

| | | | | |
|---|---|---|---|---|
| DE | 19521325 A1 | * | 1/1996 | A63H/19/24 |

* cited by examiner

*Primary Examiner*—Jacob K. Ackun

(57) ABSTRACT

A radio-controlled toy train for allowing a user to easily control forward and reverse movement of a toy train upon a track. The radio-controlled toy train includes a plurality of toy train cars including a prime mover having a train engine-shaped body mounted upon wheels; and includes a track being adapted to rest upon a surface and upon which the plurality of toy train cars move; and further includes a radio transmitter assembly including a handheld housing having walls, and also including a radio transmitter being disposed in the handheld housing; and further includes a radio receiver assembly being disposed in and upon the prime mover for receiving signals from the radio transmitter; and includes a drive assembly being disposed in the prime mover for propelling the prime mover upon the track.

5 Claims, 3 Drawing Sheets

RADIO-CONTROLLED TOY TRAIN

BACKGROUND OF THE INVENTION

1. Field of the Invention

The present invention relates to remote-controlled toy trains and more particularly pertains to a new radio-controlled toy train for allowing a user to easily control forward and reverse movement of a toy train upon a track.

2. Description of the Prior Art

The use of remote-controlled toy trains is known in the prior art. More specifically, remote-controlled toy trains heretofore devised and utilized are known to consist basically of familiar, expected and obvious structural configurations, notwithstanding the myriad of designs encompassed by the crowded prior art which have been developed for the fulfillment of countless objectives and requirements.

The prior art includes train sets having remote control units to drive the trains upon tracks. While these devices fulfill their respective, particular objectives and requirements, the aforementioned prior art do not disclose a new radio-controlled toy train.

SUMMARY OF THE INVENTION

The general purpose of the present invention, which will be described subsequently in greater detail, is to provide a new radio-controlled toy train which has many of the advantages of the remote-controlled toy trains mentioned heretofore and many novel features that result in a new radio-controlled toy train which is not anticipated, rendered obvious, suggested, or even implied by any of the prior art remote-controlled toy trains, either alone or in any combination thereof. The present invention includes a plurality of toy train cars including a prime mover having a train engine-shaped body mounted upon wheels; and includes a track being adapted to rest upon a surface and upon which the plurality of toy train cars move; and further includes a radio transmitter assembly including a handheld housing having walls, and also including a radio transmitter being disposed in the handheld housing; and further includes a radio receiver assembly being disposed in and upon the prime mover for receiving signals from the radio transmitter; and includes a drive assembly being disposed in the prime mover for propelling the prime mover upon the track. None of the prior art describes the particular radio transmitter of the present invention which has a built-in safety shutoff mechanism.

There has thus been outlined, rather broadly, the more important features of the radio-controlled toy train in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new radio-controlled toy train which has many of the advantages of the remote-controlled toy trains mentioned heretofore and many novel features that result in a new radio-controlled toy train which is not anticipated, rendered obvious, suggested, or even implied by any of the prior art remote-controlled toy trains, either alone or in any combination thereof.

Still another object of the present invention is to provide a new radio-controlled toy train for allowing a user to easily control forward and reverse movement of a toy train upon a track.

Still yet another object of the present invention is to provide a new radio-controlled toy train that is easy and convenient to use.

Even still another object of the present invention is to provide a new radio-controlled toy train that provides fun-filled entertainment for people of all ages and is also designed to protect against the prime mover moving without user interaction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
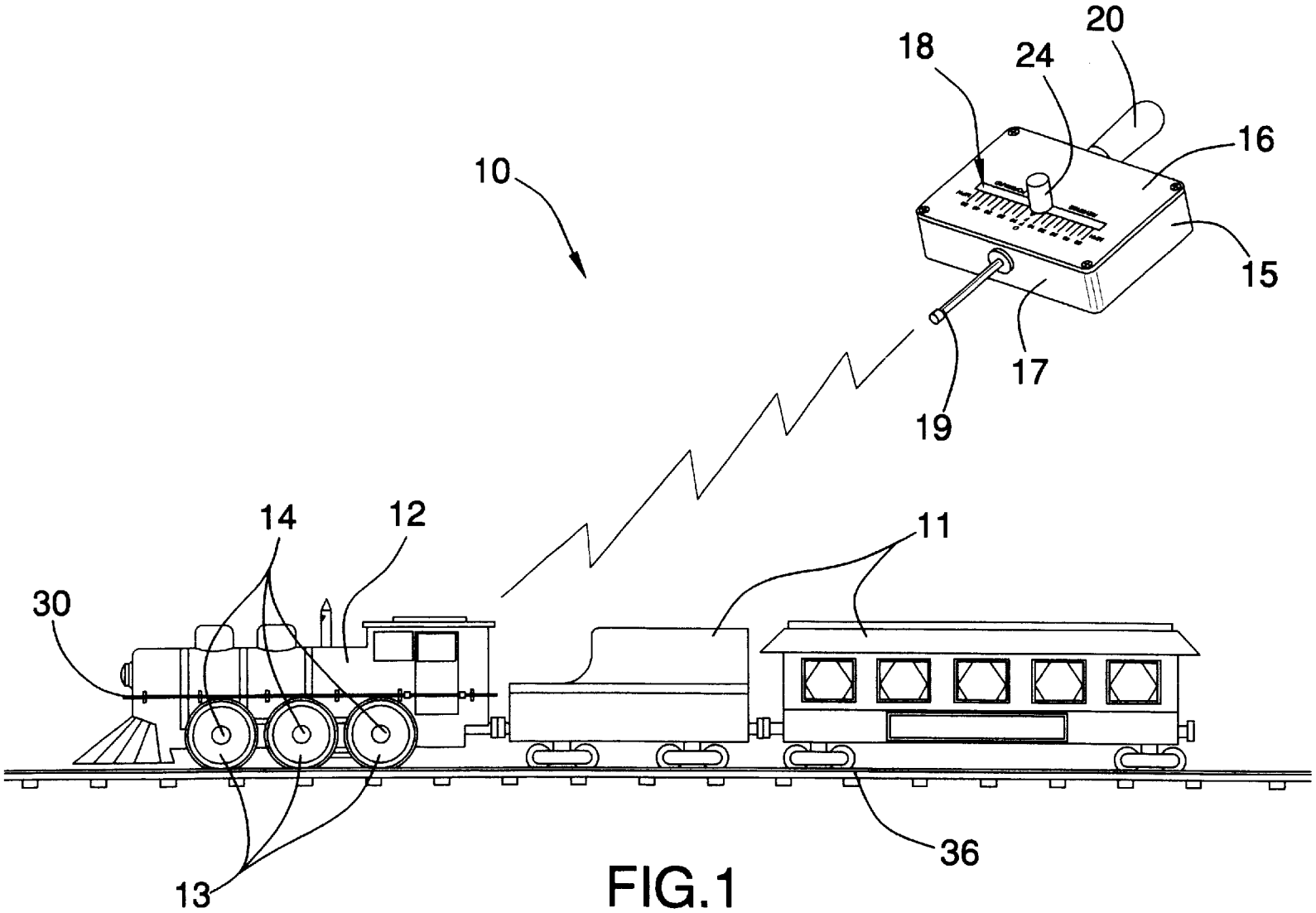
FIG. 1 is a side elevational view of a new radio-controlled toy train according to the present invention.
Figure 2:
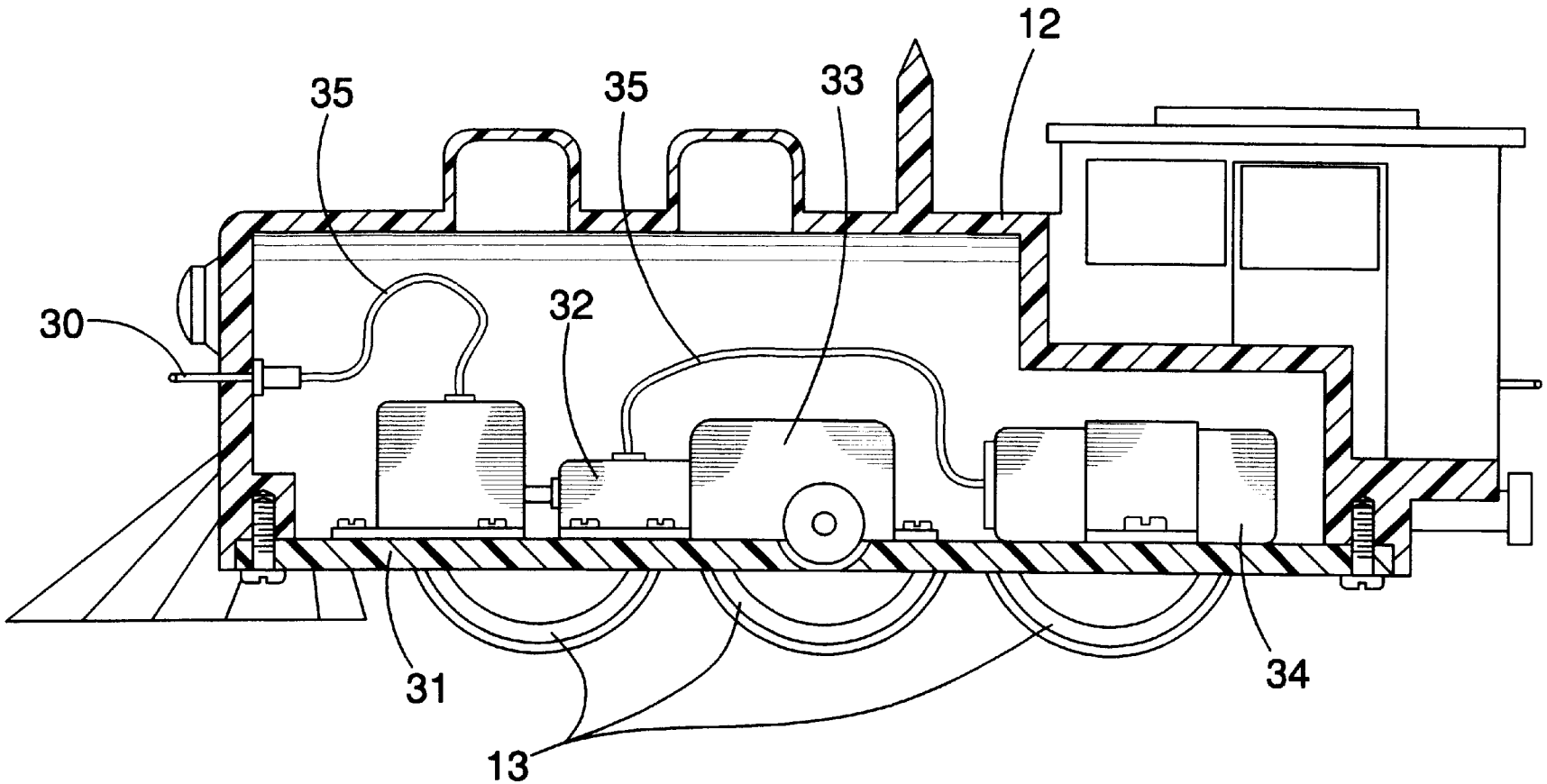
FIG. 2 is a cross-sectional view of the prime mover of the present invention.
Figure 3:
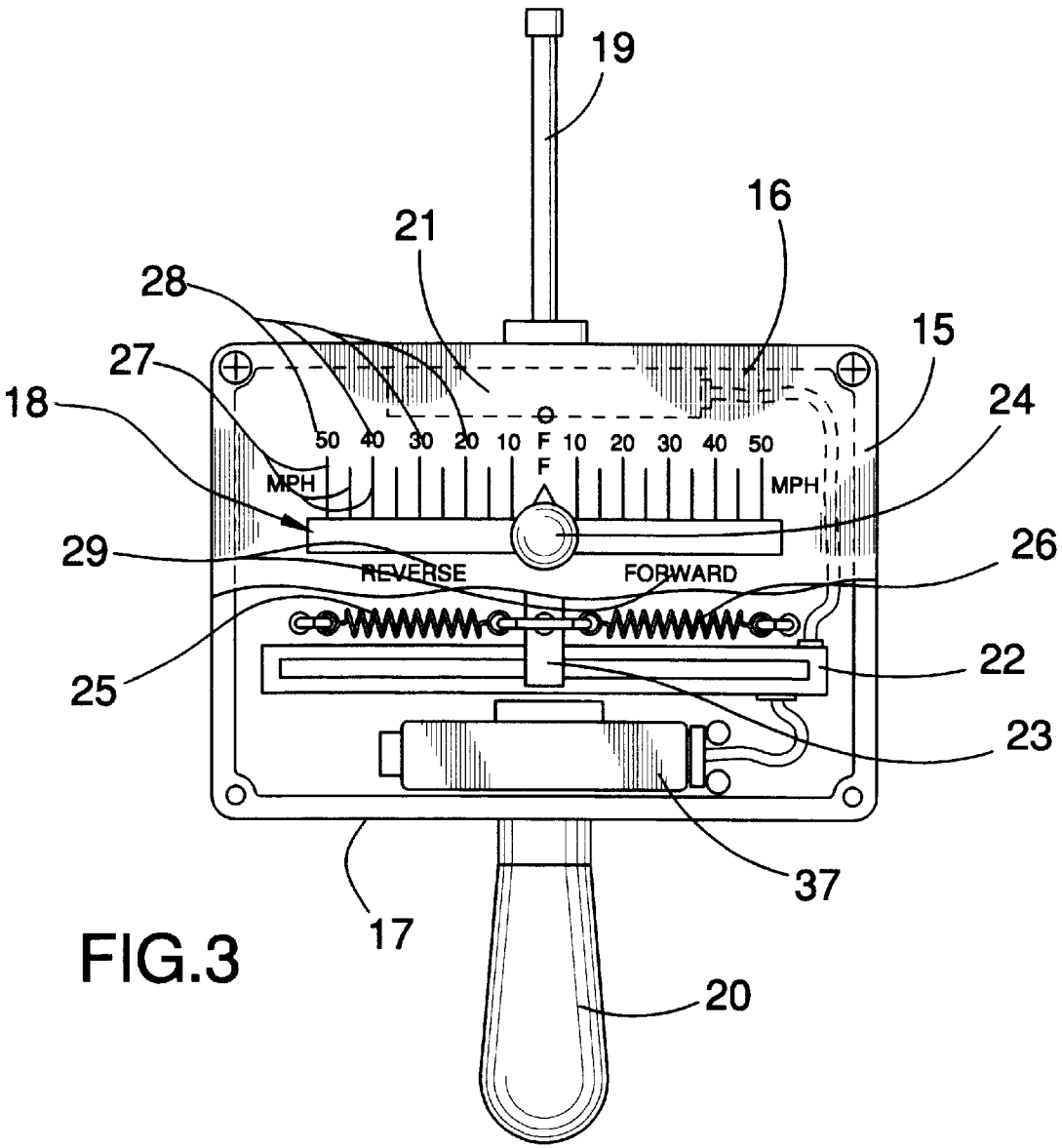
FIG. 3 is a cutaway front view of the radio-transmitting assembly of the present invention.

With reference now to the drawings, and in particular to FIGS. 1 through 3 thereof, a new radio-controlled toy train embodying the principles and concepts of the present invention and generally designated by the reference numeral 10 will be described.

As best illustrated in FIGS. 1 through 3, the radio-controlled toy train 10 generally comprises a plurality of toy train cars 11,12 including a prime mover 12 having a train engine-shaped body conventionally mounted upon wheels 13. A track 36 is adapted to rest upon a surface and upon which the plurality of toy train cars 11,12 move.

A radio transmitter assembly includes a handheld housing 15 having walls 16,17, and also including a radio transmitter 21 being conventionally disposed in the handheld housing 15, and further including a battery member 37 being conventionally connected to the radio transmitter 21 for the energizing thereof. The radio transmitter assembly further includes an antenna 19 being conventionally attached to one of the walls 16,17 of the handheld housing 15 and being conventionally connected to the radio transmitter 21, and also includes a handle 20 being conventionally attached to one of the walls 16,17 of the handheld housing 15 and extending outwardly therefrom. The handheld housing 15 also has an elongate slot 18 being disposed through a top wall 16 thereof. The radio transmitter assembly further includes a speed control switch/transmitter 22 being conventionally disposed in the handheld housing 15 and having a lever 23 being slidably and conventionally disposed in the handheld housing 15, and also having biased elements 25,26 being securely and conventionally attached to the handheld housing 15 and being opposedly connected to the lever 23 for centering the lever 23 which biases the speed of the prime mover 12 to approximately zero without user interaction. The speed control switch/transmitter 22 also includes a handle member 24 being conventionally attached to the lever 23 and extending through the elongate slot 18 in the handheld housing 15. The radio transmitter assembly further includes a plurality of markings 27 being spaced parallel and being conventionally disposed along an edge of the elongate slot 18 through the top wall 16 of the handheld housing 15, and also includes numbers 28 being conventionally disposed adjacent to the markings 27 and representing a simulated speed of the prime mover 12, and further includes directional words 29 also being conventionally disposed along an edge of the elongate slot 18.

A radio receiver assembly is conventionally disposed in and upon the prime mover 12 for receiving signals from the radio transmitter 21. The radio receiver assembly includes an antenna member 30 being conventionally disposed through a front wall of the train engine-shaped body 12, and also includes a radio receiver 31 being conventionally disposed in the train engine-shaped body 12 and being connected with wires 35 to the antenna member 30.

A drive assembly is conventionally disposed in the prime mover 12 for propelling the prime mover 12 upon the track 36. The drive assembly includes a speed controller unit 32 being conventionally disposed in the train engine-shaped body 12 and being conventionally connected to the radio receiver 32, and also includes a two-directional motor 33 being connected with wires 35 to the speed controller unit 32 and having a rotatable shaft which is conventionally attached to axles of the wheels 13 of the prime mover 12, and further includes a battery 34 being conventionally disposed in the train engine-shaped body 12 and being connected with wires 35 to the two-directional motor 33 for the energizing thereof.

In use, the user moves the lever 23 using the handle member 24 to move the prime mover 12 upon the track 36. If the lever 23 is moved in a particular direction, the speed control switch/transmitter 22 sends a signal to the radio transmitter 21 which transmits a signal to the radio receiver 31 which signals the speed control unit 32 to energize the two-directional motor 33 which actuates the wheels 13 for moving the prime mover 12. The prime mover can move forward or backward depending upon the direction the lever 23 is moved. The biased elements 25,26 provide a safety mechanism by automatically shutting down the prime mover 12 when the user releases the lever 23.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the radio-controlled toy train. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A radio-controlled toy train comprising:

a plurality of toy train cars including a prime mover having a train engine-shaped body mounted upon wheels;

a track being adapted to rest upon a surface and upon which said plurality of toy train cars move;

a radio transmitter assembly including a handheld housing having walls, and also including a radio transmitter being disposed in said handheld housing, and further including a battery member for the energizing thereof, said radio transmitter assembly further includes an antenna being attached to one of said walls of said handheld housing and being connected to said radio transmitter, and also includes a handle being attached to one of said walls of said handheld housing and extending outwardly therefrom, said handheld housing also has an elongate slot being disposed through a top wall thereof, said radio transmitter assembly further including a speed control switch/transmitter being disposed in said handheld housing and having a lever being slidably disposed in said handheld housing, and also having biased elements being securely attached to said handheld housing and being opposedly connected to said lever for biasing the speed of said prime mover to approximately zero without user interaction;

a radio receiver assembly being disposed in and upon said prime mover for receiving signals from said radio transmitter; and a drive assembly being disposed in said prime mover for propelling said prime mover upon said track.

2. A radio-controlled toy train as described in claim 1, wherein said speed control switch/transmitter also includes a handle member being attached to said lever and extending through said elongate slot in said handheld housing.

3. A radio-controlled toy train as described in claim 2, wherein said radio transmitter assembly further includes a plurality of markings being spaced parallel and being disposed along an edge of said elongate slot through said top wall of said handheld housing, and also includes numbers being disposed adjacent to said markings and representing a simulated speed of said prime mover, and further includes directional words also being disposed along an edge of said elongate slot.

4. A radio-controlled toy train as described in claim 1, wherein said radio receiver assembly includes an antenna member being disposed through a front wall of said train engine-shaped body, and also including a radio receiver being disposed in said train engine-shaped body and being connected to said antenna member.

5. A radio-controlled toy train as described in claim 4, wherein said drive assembly includes a speed controller unit being disposed in said train engine-shaped body and being connected to said radio receiver, and also includes a two-directional motor being connected to said speed controller unit and having a rotatable shaft which is attached to axles of said wheels of said prime mover, and further includes a battery being disposed in said train engine-shaped body and being connected to said two-directional motor for the energizing thereof.

* * * * *